US012566033B2

(12) United States Patent
Wang et al.

(10) Patent No.: US 12,566,033 B2
(45) Date of Patent: Mar. 3, 2026

(54) THREE-DIMENSIONAL VAPOR CHAMBER DEVICE

(71) Applicant: JWS TECHNOLOGY CO., LTD., New Taipei (TV)

(72) Inventors: Cheng-Tu Wang, New Taipei (TW); Pang-Hung Liao, New Taipei (TW); Chih-Wei Chen, New Taipei (TW)

(73) Assignee: JWS TECHNOLOGY CO., LTD., New Taipei City (TW)

( * ) Notice: Subject to any disclaimer, the term of this patent is extended or adjusted under 35 U.S.C. 154(b) by 186 days.

(21) Appl. No.: 18/533,945

(22) Filed: Dec. 8, 2023

(65) Prior Publication Data

US 2025/0189239 A1 Jun. 12, 2025

(51) Int. Cl.
*F28D 15/04* (2006.01)

(52) U.S. Cl.
CPC ..... *F28D 15/043* (2013.01); *F28D 15/046* (2013.01); *F28F 2215/04* (2013.01)

(58) Field of Classification Search
CPC .. F28D 15/043; F28D 15/046; F28D 15/0233; F28D 15/0275; F28F 2215/04; F28F 2215/06
See application file for complete search history.

(56) References Cited

U.S. PATENT DOCUMENTS 5,076,351 A * 12/1991 Munekawa ..... F28D 15/0233 165/104.31
5,253,702 A * 10/1993 Davidson ..... F28D 15/0266 29/890.032
5,647,430 A * 7/1997 Tajima ..... F28F 3/025 257/E23.099
5,998,863 A * 12/1999 Kobayashi ..... F28F 3/12 361/699
6,005,772 A * 12/1999 Terao ..... F28D 15/0266 165/80.4

(Continued)

FOREIGN PATENT DOCUMENTS

TW 202234009 A 9/2022
TW M638040 U 2/2023

OTHER PUBLICATIONS

Office Action dated Jul. 3, 2024 of the corresponding Taiwan patent application No. 112141630.

*Primary Examiner* — Travis Ruby
(74) *Attorney, Agent, or Firm* — HDLS IPR SERVICES; Chun-Ming Shih

(57) ABSTRACT

This disclosure is directed to a three-dimensional vapor chamber device having a thermal base, a vertical thermal plate arranged up-right on the thermal base, and a working fluid accommodated in the thermal base and may flow to the vertical thermal plate. A first chamber having a first capillary structure is defined in the thermal base. A second chamber having a second capillary structure is defined in the vertical thermal plate. The first chamber and the second chamber are connected with an inlet and a return port. The second chamber has a flow channel structure connected between the inlet and the return port. The working fluid may flow to the second chamber through the inlet, pass the flow channel structure and return to the first chamber through the return port, so to define a specific flow path leading to a desirable and stable heat transfer efficiency.

6 Claims, 11 Drawing Sheets

(56) References Cited

U.S. PATENT DOCUMENTS 6,321,831 B1* 11/2001 Tanaka ..... H01L 23/427 165/174
6,341,645 B1* 1/2002 Tanaka ..... F25B 23/006 165/104.21
6,341,646 B1* 1/2002 Tanaka ..... F28D 15/0266 165/104.21
6,357,517 B1* 3/2002 Osakabe ..... F28D 15/0233 165/104.21
6,360,814 B1* 3/2002 Tanaka ..... H05K 7/20681 361/699
8,678,075 B2 3/2014 Wang et al.
10,281,220 B1* 5/2019 Lin ..... H01L 21/4871
2002/0166655 A1* 11/2002 Sugito ..... F28D 15/0233 165/104.21
2003/0079863 A1* 5/2003 Sugito ..... H05K 7/1418 257/E23.098
2004/0011511 A1* 1/2004 Ghosh ..... F28D 15/0266 257/E23.099
2005/0274496 A1* 12/2005 Ishii ..... F28D 15/046 257/E23.088
2007/0246193 A1* 10/2007 Bhatti ..... H01L 23/467 257/E23.099
2013/0008633 A1* 1/2013 Gradinger ..... F28D 15/0266 165/104.34
2013/0077245 A1* 3/2013 Gradinger ..... H01L 23/427 165/170
2013/0340978 A1* 12/2013 Agostini ..... H05K 7/20309 165/104.21
2017/0003083 A1* 1/2017 Manninen ..... H05K 7/20327
2018/0017335 A1* 1/2018 Lin ..... H01L 23/473
2018/0192545 A1* 7/2018 Chen ..... H05K 7/20409
2018/0308780 A1* 10/2018 Tong ..... H01L 23/3733
2019/0049190 A1* 2/2019 Liu ..... F28F 1/325
2020/0232717 A1* 7/2020 Kao ..... F28F 3/06
2020/0315064 A1* 10/2020 Agostini ..... H05K 7/20336
2021/0041181 A1* 2/2021 Liu ..... F28D 15/04
2021/0215433 A1* 7/2021 Takabayashi ..... H01L 23/3672
2021/0318071 A1* 10/2021 Hart ..... F28D 1/0316
2022/0128316 A1* 4/2022 Wen ..... F28D 15/0233
2022/0163269 A1* 5/2022 Horng ..... F28F 3/046
2022/0200125 A1* 6/2022 Ji ..... F28F 3/12
2022/0205723 A1* 6/2022 Chen ..... F28D 15/0266
2022/0205739 A1* 6/2022 Chen ..... F28F 3/06
2023/0047466 A1* 2/2023 Jiang ..... F28D 15/0266
2023/0098311 A1* 3/2023 Chen ..... F28D 15/043 165/104.26
2023/0156962 A1* 5/2023 Stetsyuk ..... H05K 7/20418 361/704
2023/0156970 A1* 5/2023 Hong ..... H05K 7/20509 361/700
2023/0184491 A1* 6/2023 Wang ..... F28D 15/0266 165/166
2023/0371201 A1* 11/2023 Wang ..... H05K 7/20681
2024/0053113 A1* 2/2024 Müller ..... F28D 15/0266
2024/0140622 A1* 5/2024 Freestone ..... F28D 15/0283
2024/0151333 A1* 5/2024 Liao ..... F28F 21/081
2024/0230241 A1* 7/2024 Cheng ..... F28D 15/0275
2024/0310127 A1* 9/2024 Yeh ..... F28D 15/0233

* cited by examiner

THREE-DIMENSIONAL VAPOR CHAMBER DEVICE

BACKGROUND OF THE DISCLOSURE

Technical Field

This disclosure is directed to a three-dimensional vapor chamber device, particularly directed to a three-dimensional vapor chamber device having a vertical thermal plate, the vertical thermal plate has a flow channel structure capable of guiding a working fluid to flow along a specific path.

Description of Related Art

A related art three-dimensional vapor chambers generally has a base plate and a vertical plate up-right arranged on the base plate. The base plate and the vertical plate are hollow and communicated to each other. A liquid working fluid accommodated in the base plate. When the base plate is contacts a heat source and absorbs heat, the liquid working fluid in the base plate is vaporized to diffuse into the vertical plate and falls into the base plate after cooling. According to the related art three-dimensional vapor chamber, the diffusion of the vaporized working fluid and the returning of the liquid working fluid are performed in the same space in the vertical plate, and the working fluids at different temperatures are mixed so that the heat flowing back to the heat source. Therefore, a heat dissipation performance of the related art three-dimensional vapor chamber is not effective.

SUMMARY OF THE DISCLOSURE

This disclosure is directed to a three-dimensional vapor chamber device having a vertical thermal plate, which has a flow channel structure capable of guiding a working fluid to flow along a specific path.

This disclosure is directed to a three-dimensional vapor chamber device having a thermal conductive base, a vertical thermal plate and a working fluid. The thermal conductive base has a heat exchanging surface and a heat defusing surface opposite to the heat exchanging surface, a heat exchanging area is defined on the heat exchanging surface, a first chamber is defined in the thermal conductive base, and a first capillary structure is attached on an internal surface of the first chamber. The vertical thermal plate is up-right disposed on the heat defusing surface. A second chamber is defined in the vertical thermal plate, a second capillary structure is attached on an internal surface of the second chamber, the first chamber communicates with the second chamber through an inlet and a return port, a flow channel structure is defined in the second chamber, the flow channel structure communicates between the inlet and the return port. The working fluid is accommodated in the first chamber and capable of flowing to the second chamber through the inlet, passing the flow channel structure and flowing back to the first chamber through the return port.

In an embodiment, a flow resistance of the working fluid from the heat exchanging area to the return port is greater than a flow resistance of the working fluid from the heat exchanging area to the inlet. A distance between the heat exchanging area and the inlet is less than a distance between the heat exchanging area and the return port. A resistance structure is arranged at the return port. The resistance structure has a plurality of pores. The resistance structure is extended from the first capillary structure.

In an embodiment, the three-dimensional vapor chamber device further has a fin assembly, and the fin assembly disposed on an external surface of the vertical thermal plate. The vertical thermal plate has an extended segment, the extended segment is parallel to the heat defusing surface, and the fin assembly arranged on the extended segment.

In an operating status of the three-dimensional vapor chamber device according to this disclosure, the working fluid is vaporized at the heat exchanging area by heat absorbed from a heat source, the vaporized working fluid flows into the vertical thermal plates so as to transfer the heat to the fin assembly, and the heat is further dissipated to environment air. A period of the working fluid lingering in the vertical thermal plates is extended by the flow channel structures so as to enhance the heat exchanging of the working fluid in the vertical thermal plates. Moreover, a flow resistance of the working fluid from the heat exchanging area to the return port is greater than a flow resistance of the working fluid from the heat exchanging area to the inlet, and this arrangement leads to a flow of the working fluid along a specific path namely far from the heat source. Accordingly, the working fluid is guided by the flow channel structure to bring the heat away from the heat exchanging area, where the heat source is located. The working fluid has a specific flow path, thereby having a better and more stable heat transfer efficient.

BRIEF DESCRIPTION OF THE DRAWINGS

The features of the disclosure believed to be novel are set forth with particularity in the appended claims. The disclosure itself, however, may be best understood by reference to the following detailed description of the disclosure, which describes a number of exemplary embodiments of the disclosure, taken in conjunction with the accompanying drawings, in which:

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
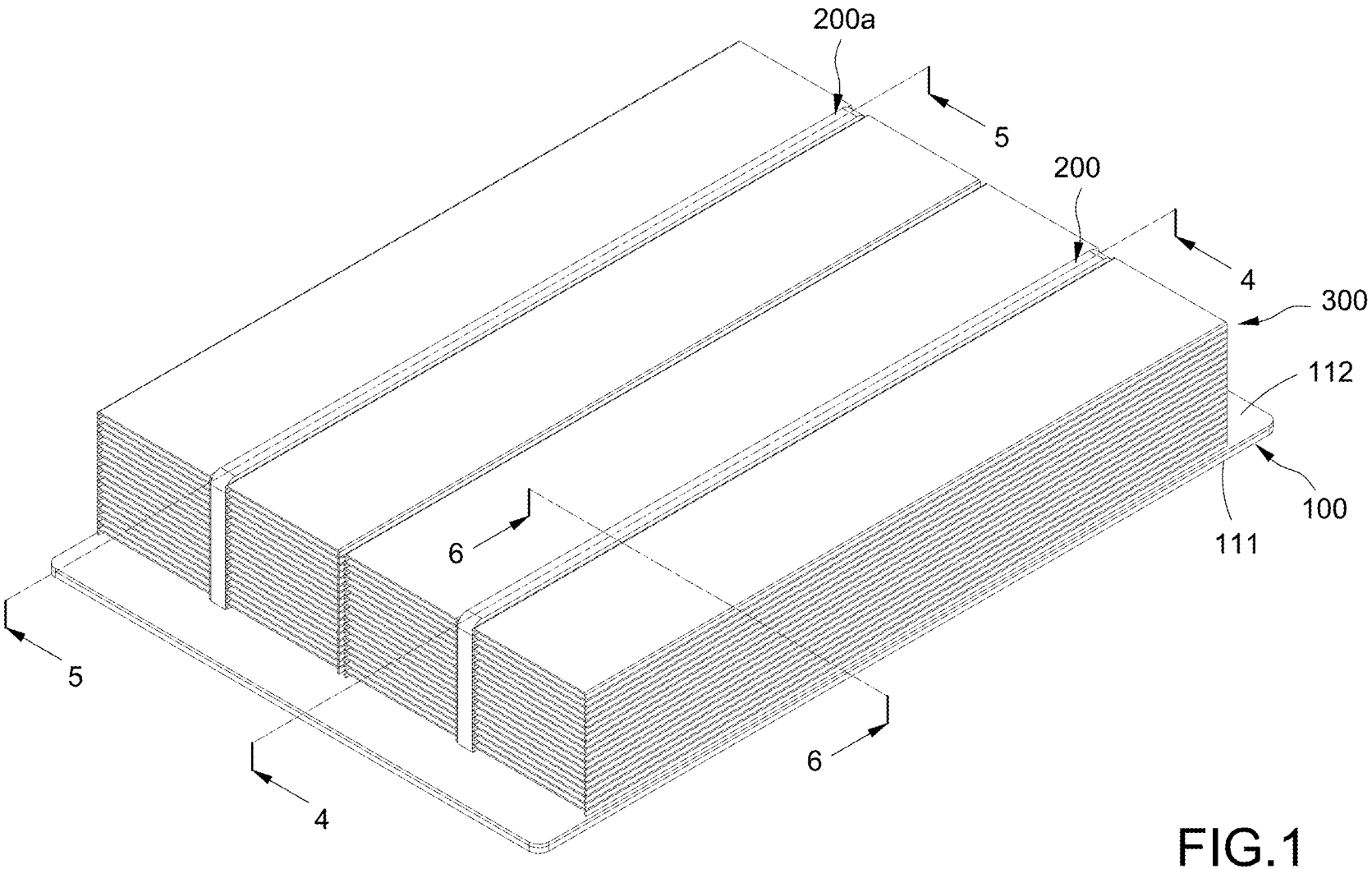
FIG. 1 is a perspective view showing a three-dimensional vapor chamber device according to an embodiment of this disclosure.
Figure 2:
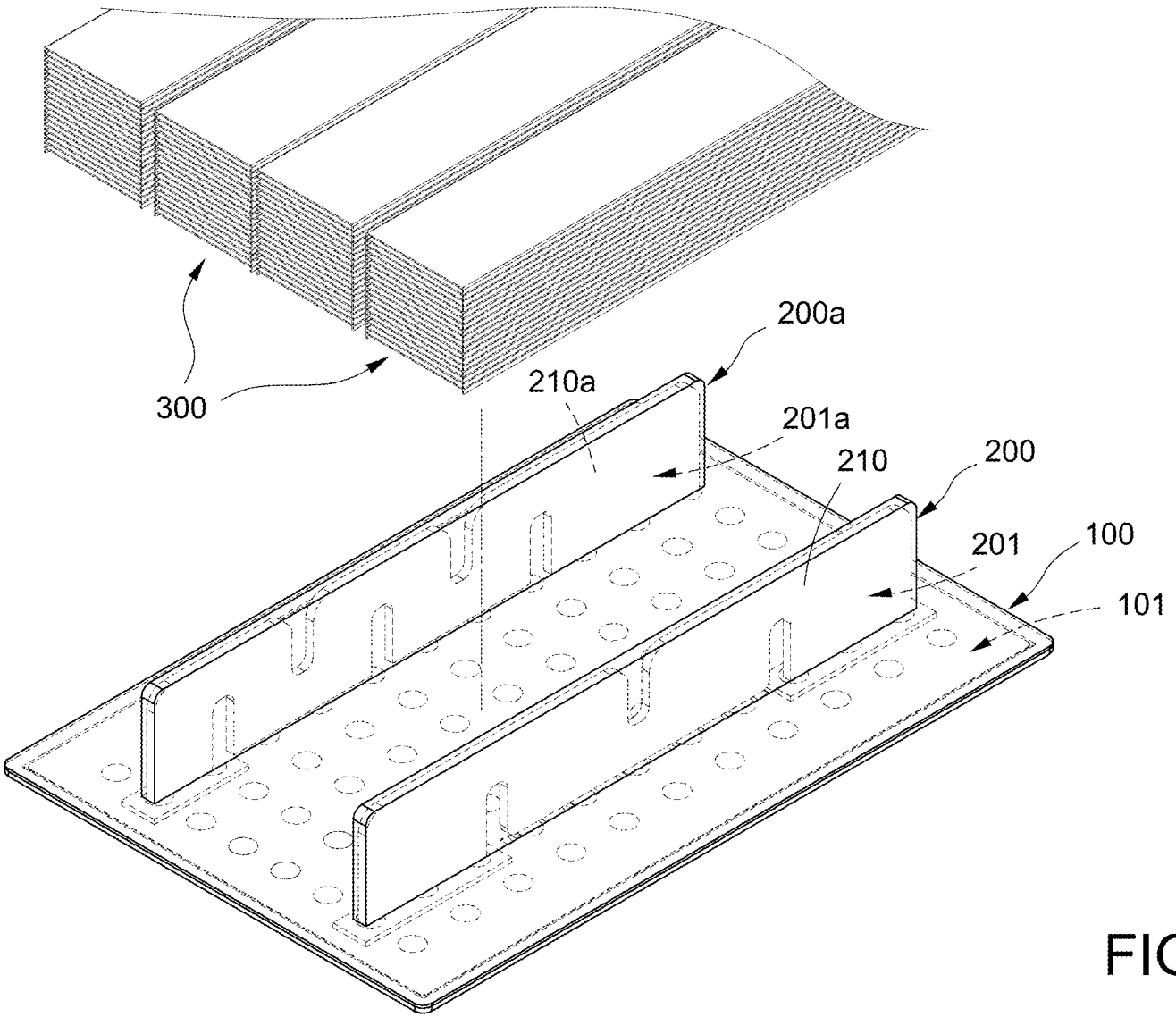
FIGS. 2 and 3 are exploded views showing the three-dimensional vapor chamber device according to the aforementioned embodiment of this disclosure.
Figure 3:
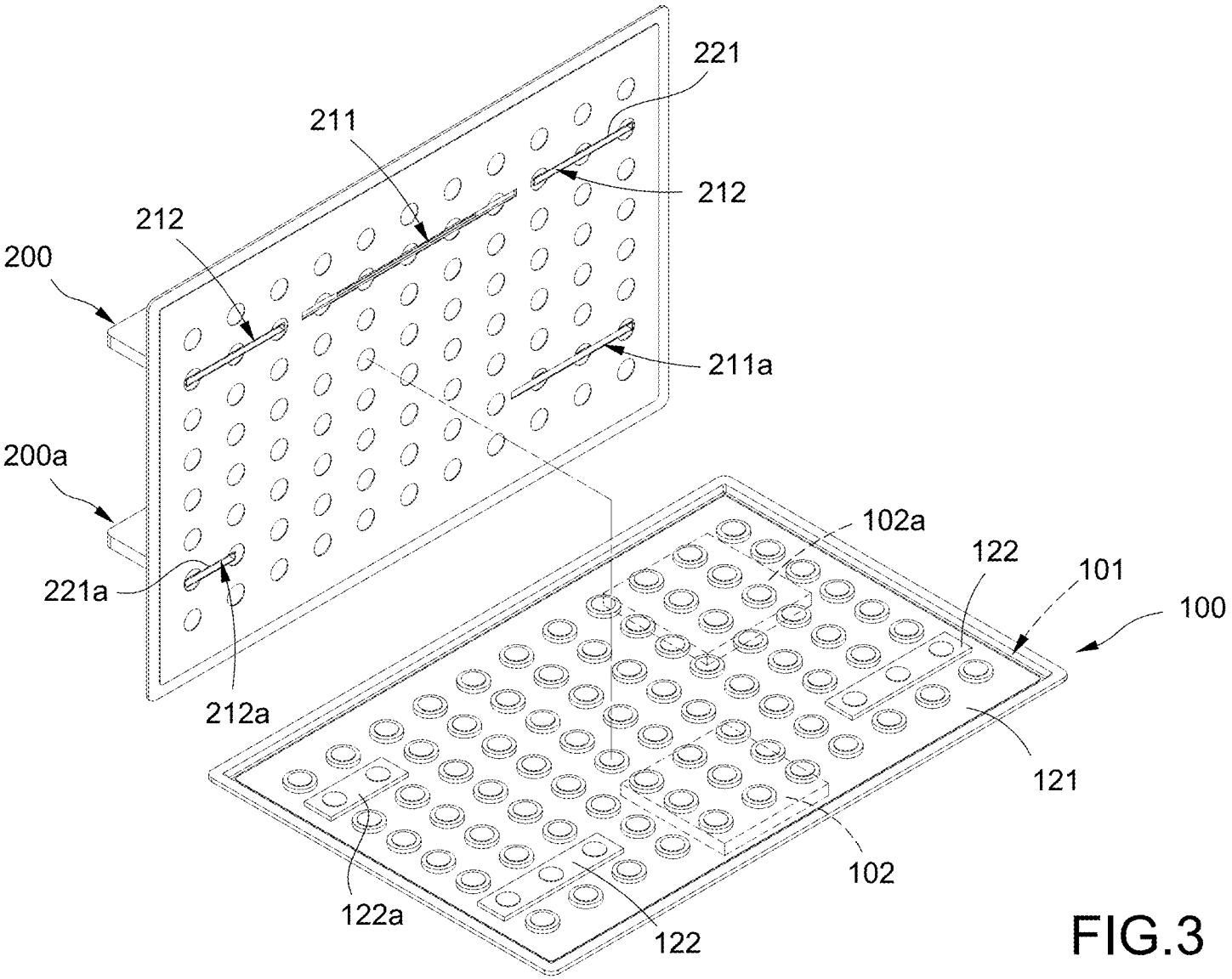

According to FIGS. 1 to 3, an embodiment of this disclosure provides a three-dimensional vapor chamber device having a thermal conductive base 100, at least one vertical thermal plate 200 and a working fluid 400. Regarding a simplest embodiment, a predetermined function of this disclosure may be achieved by single vertical thermal plate 200, although a plurality of vertical thermal plates 200, 200*a* are provided in this embodiment, scopes of this disclosure should not be limited to this embodiment.

According to this embodiment, the thermal conductive base 100 is a hollow plate having a plurality of housing parts assembled with each other, but scopes of this disclosure should not be limited to this embodiment. The thermal conductive base 100 has a heat exchanging surface 111 and a heat defusing surface 112 opposite to the heat exchanging surface 111, and at least one heat exchanging area 102 for contacting with a heat source is defined on the heat exchanging surface 111. According to this embodiment, a plurality of heat exchanging areas 102,102*a* are defined on the heat exchanging surface 111 for contacting a plurality of heat sources, but scopes of this disclosure should not be limited to this embodiment. A first chamber 101 is defined in the thermal conductive base 100, and a first capillary structure 121 is attached on an internal surface of the first chamber 101. The first capillary structure 121 has a plurality of pores, and the pores may generate capillary force for transferring liquid working fluid 400. According to this embodiment, the first capillary structure 121 is made of sintered metal powder and therefore having the plurality of pores, but scopes of this disclosure should not be limited to this embodiment. For example, other feasible approaches to form the pores in the first capillary structure 121 may be woven copper mesh, metal fiber or etching.

Figure 4:
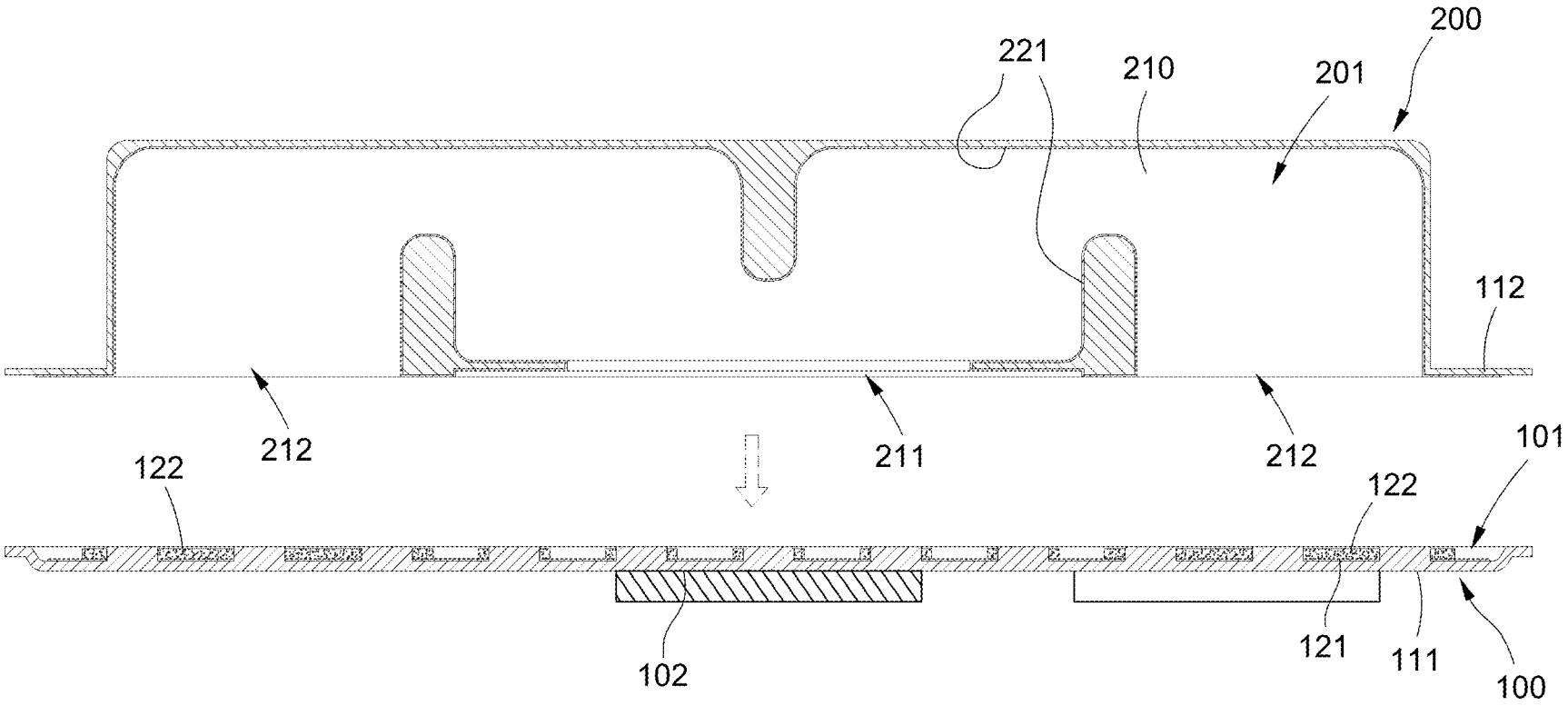
FIG. 4 is a cross-sectional view along a cross line 4-4 shown in FIG. 1.
Figure 5:
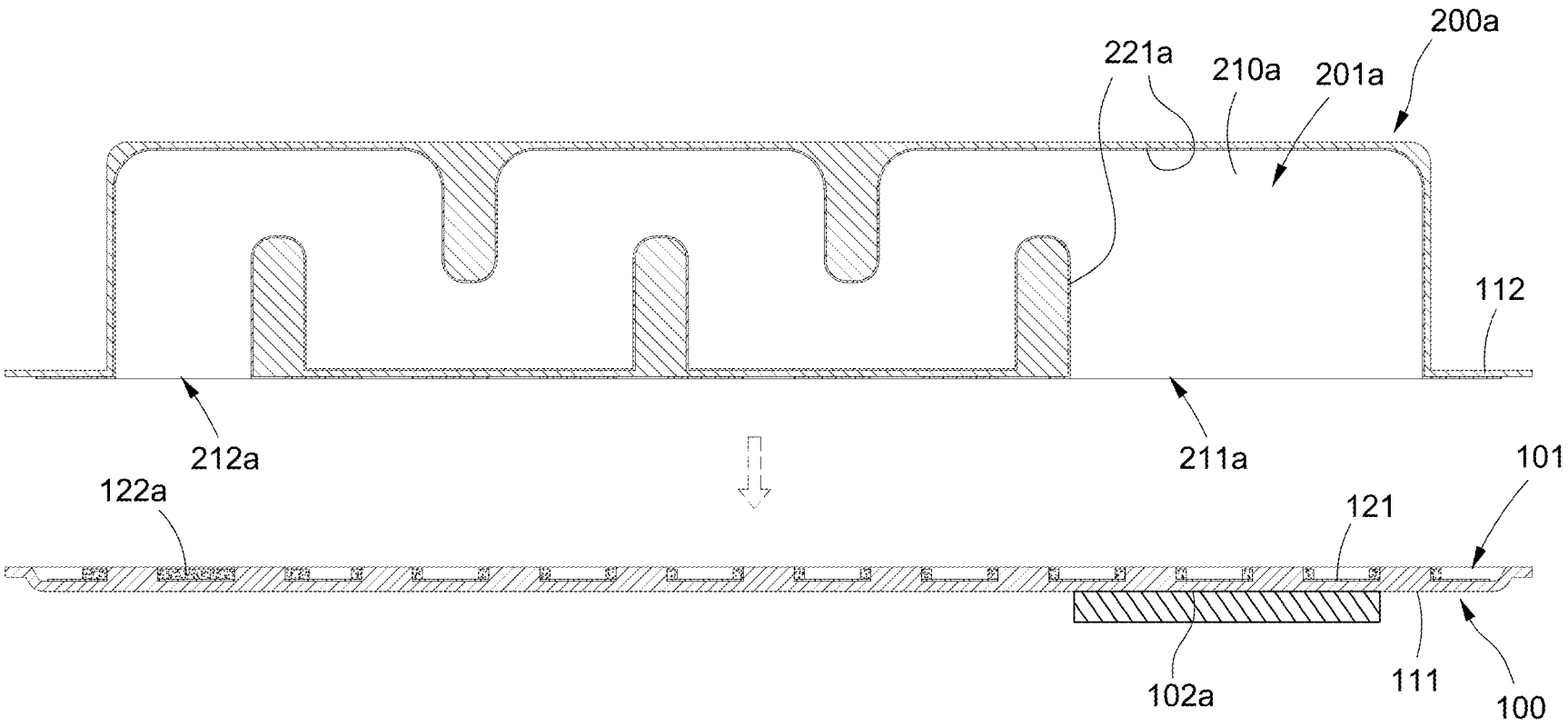
FIG. 5 is a cross-sectional view along a cross line 5-5 shown in FIG. 1.
Figure 6:
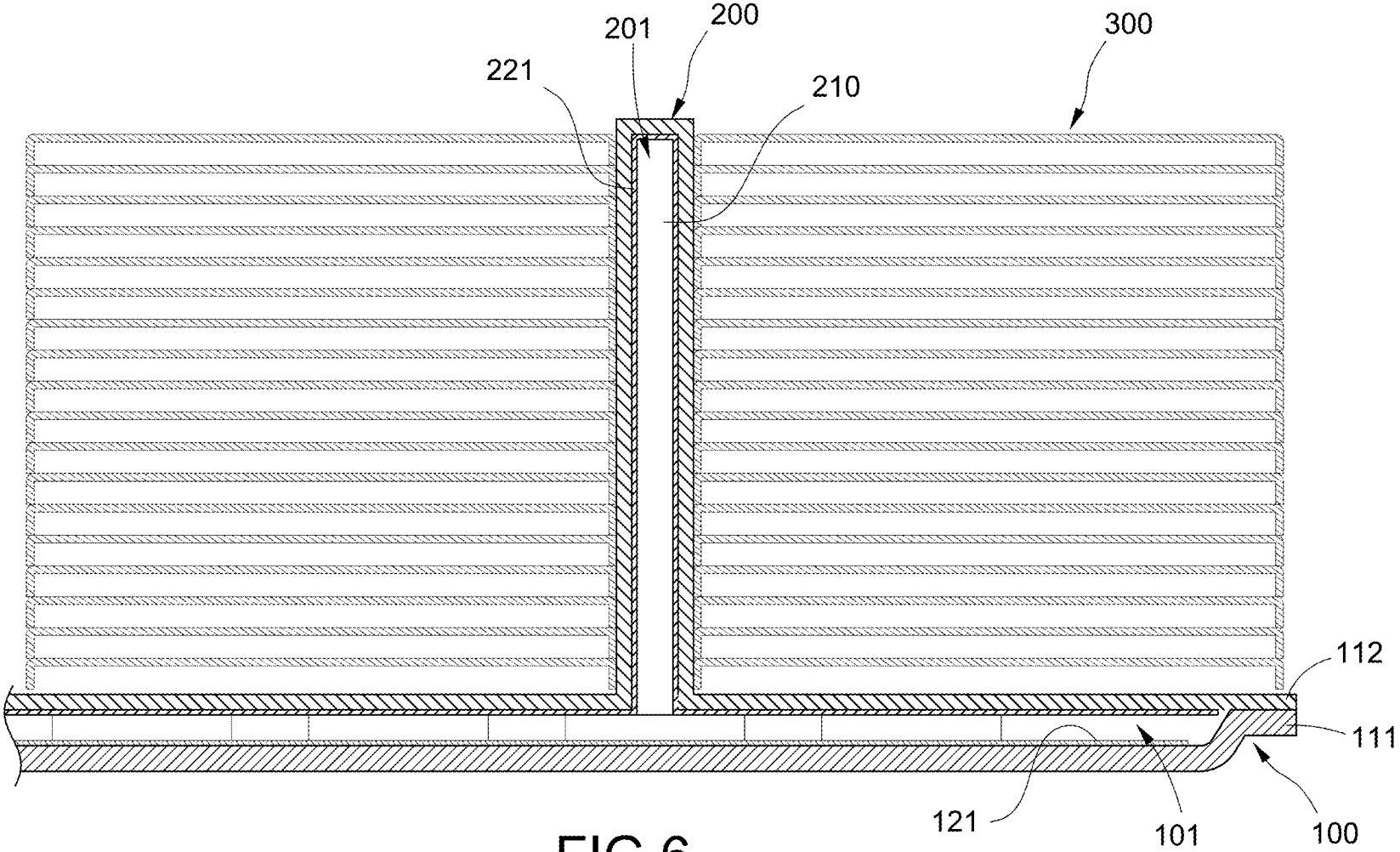
FIG. 6 is a cross-sectional view along a cross line 6-6 shown in FIG. 1.

According to FIGS. 4 to 6, in this embodiment, the vertical thermal plates 200/200*a* are hollow plates, and the vertical thermal plates 200,200*a* are respectively combined with one of housing parts of the thermal conductive base 100, but scopes of this disclosure should not be limited to this embodiment. The vertical thermal plate 200,200*a* are up-right arranged on the heat defusing surface 112 of the thermal conductive base 100, and a second chamber 201/201*a* is defined in each vertical thermal plate 200/200*a*. A second capillary structure 221/221*a* is attached on an internal surface of each second chamber 201/201*a*. The second capillary structures 221, 221*a* have a plurality of pores, and the pores may generate capillary force for transferring liquid working fluid 400. According to this embodiment, the second capillary structures 221, 221*a* are made of sintered metal powder and therefore having the plurality of pores therein, but scopes of this disclosure should not be limited to this embodiment. For example, other feasible approaches to form the pores in the second capillary structures 221, 221*a* may be woven copper mesh, metal fiber or etching. The first chamber 101 respectively communicates to each second chamber 201/201*a* through an inlet 211/211*a* and a return port 212/212*a*. A flow channel structure 210/210*a* is defined in each second chamber 201/201*a*, and each flow channel structure 210/210*a* is correspondingly connected between the inlet 211/211*a* of the second chamber 201/201*a* and the return port 212/212*a*.

The three-dimensional vapor chamber device according to this disclosure further has at least one fin assembly 300, the fin assembly 300 is arranged on an external surface of the vertical thermal plate 200/200*a*. According to this embodiment, the three-dimensional vapor chamber device further has a plurality of fin assemblies 300 and the fin assemblies 300 are respectively arranged on the external surface of the vertical thermal plates 200, 200*a* corresponding thereto. The fin assembly 300 is capable of exchanging heat with the environment air.

Figure 7:
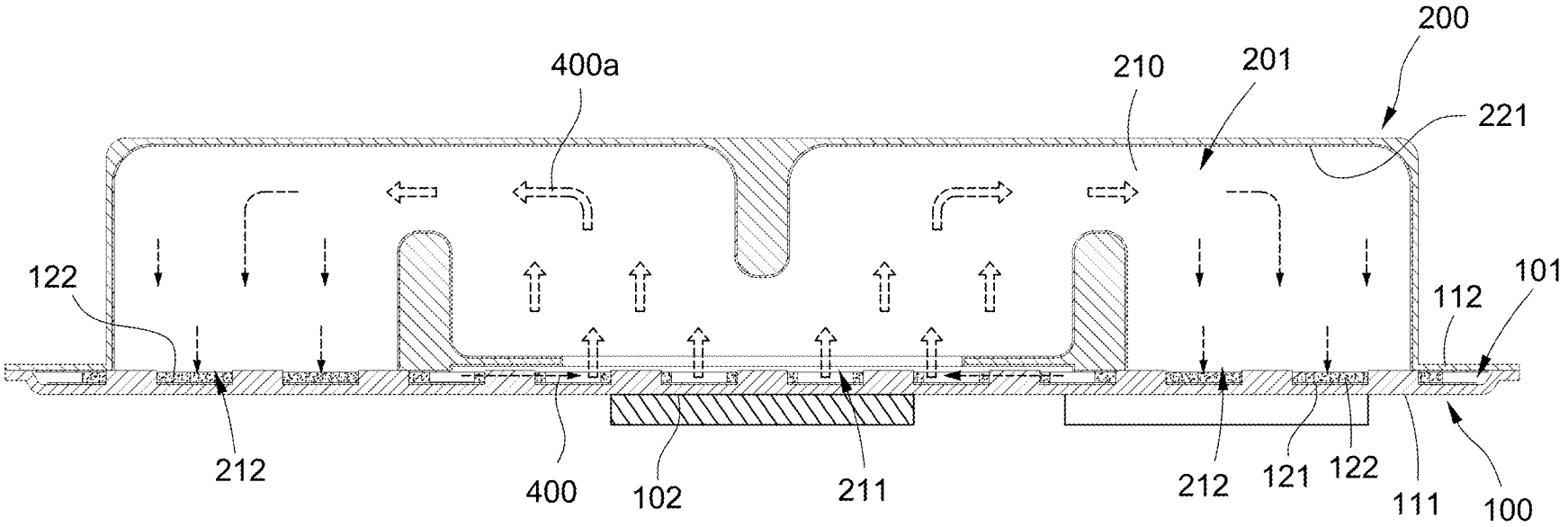
FIG. 7 is a cross-sectional view along a cross line 5-5 shown in FIG. 1 which showing the three-dimensional vapor chamber device in an operating status according to the aforementioned embodiment of this disclosure.
Figure 8:
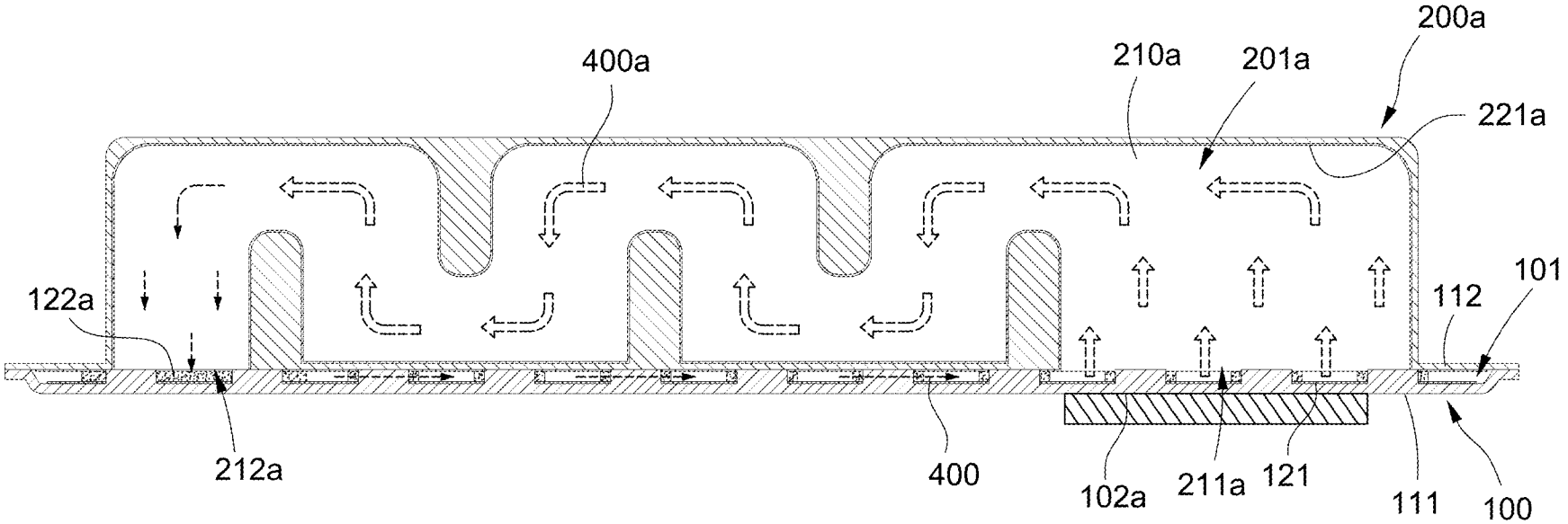
FIG. 8 is a cross-sectional view along a cross line 6-6 shown in FIG. 1 which showing the three-dimensional vapor chamber device in an operating status according to the aforementioned embodiment of this disclosure.

According to FIGS. 7 and 8, the liquid working fluid 400 accommodated in the first chamber 101 may be vaporized to flow to the second chambers 201, 201*a* through the inlets 211, 211*a*, pass the flow channel structures 210, 210*a*, and then flow back to the first chamber 101 through the return ports 212, 212*a*, respectively. A flow resistance of the vaporized working fluid 400*a* from each heat exchanging area 102/102*a* to the return port 212/212*a* is greater than a flow resistance of the vaporized working fluid 400*a* from each heat exchanging area 102/102*a* to the inlet 211/211*a*, so that the vaporized working fluid 400*a* flows toward the inlets 211, 211*a* and enters the vertical thermal plates 200/200*a*.

According to this embodiment, correspondingly, a distance between the heat exchanging area 102/102*a* and the inlet 211/211*a* is less than a distance between the heat exchanging area 102/102*a* and the return port 212/212*a*, so that a flow resistance of the vaporized working fluid 400*a* from the heat exchanging areas 102/102*a* to the return ports 212*b*/212*c* is greater than a flow resistance of the vaporized working fluid 400*a* from the heat exchanging areas 102/102*a* to the inlet 211*b*/211*c*. A resistance structure 122/122*a* is disposed at each return port 212/212*a*, so that a flow resistance of the vaporized working fluid 400*a* from the heat exchanging area 102/102*a* toward the return port 212/212*a* is greater than a flow resistance of the vaporized working fluid 400*a* from the heat exchanging areas 102/102*a* toward the inlet 211/211*a*. The resistance structures 122, 122*a* may be made of sintered metal powder and therefore having the plurality of pores therein, and the resistance structures 122, 122*a* may be extended from the first capillary structure 121.

In an operated status of the three-dimensional vapor chamber device according to this disclosure, the liquid working fluid 400*a* may be vaporized by heat absorbed from the heat source at the heat exchanging areas 102, 102*a* respectively, the vaporized working fluid 400*a* flows into the vertical thermal plates 200, 200*a* to transfer the heat to the air fin assembly 300 and dissipate it to the environment. A period of the vaporized working fluid 400*a* lingering in the vertical thermal plate 200/200*a* is extended by the flow channel structure 210/210*a* so as to enhance the heat exchanging of the vaporized working fluid 400*a* in the vertical thermal plates 200, 200*a*. Moreover, a flow resistance of the working fluid 400*a* from the heat exchanging area 102/102*a* to the return port 212/212*a* is larger than the flow resistance of the working fluid 400*a* from the heat exchanging area 102/102*a* to the inlet 211, and this arrangement make the working fluid 400*a* to correspondingly flows in to the vertical thermal plates 200/200*a* via the inlets 211/211*a* and pass the flow channel structure 210/210*a* along a specific path namely away from the heat source, so that the working fluid 400*a* may be guided by the flow channel structure 210/210*a* to bring the heat away from the heat exchanging area 102, where the heat source is located.

Figure 9:
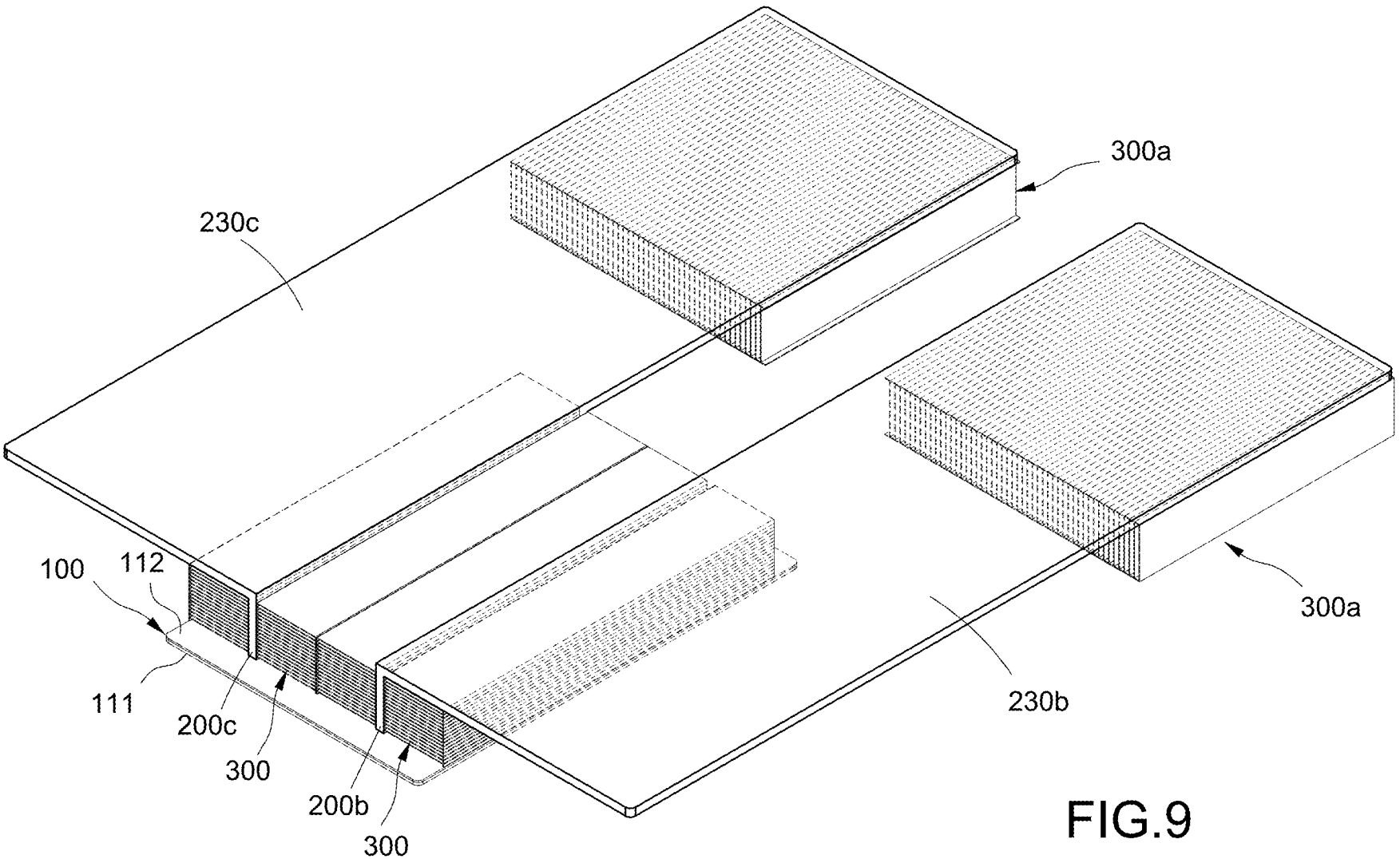
FIG. 9 is a perspective view showing a three-dimensional vapor chamber device according to another embodiment of this disclosure.
Figure 10:
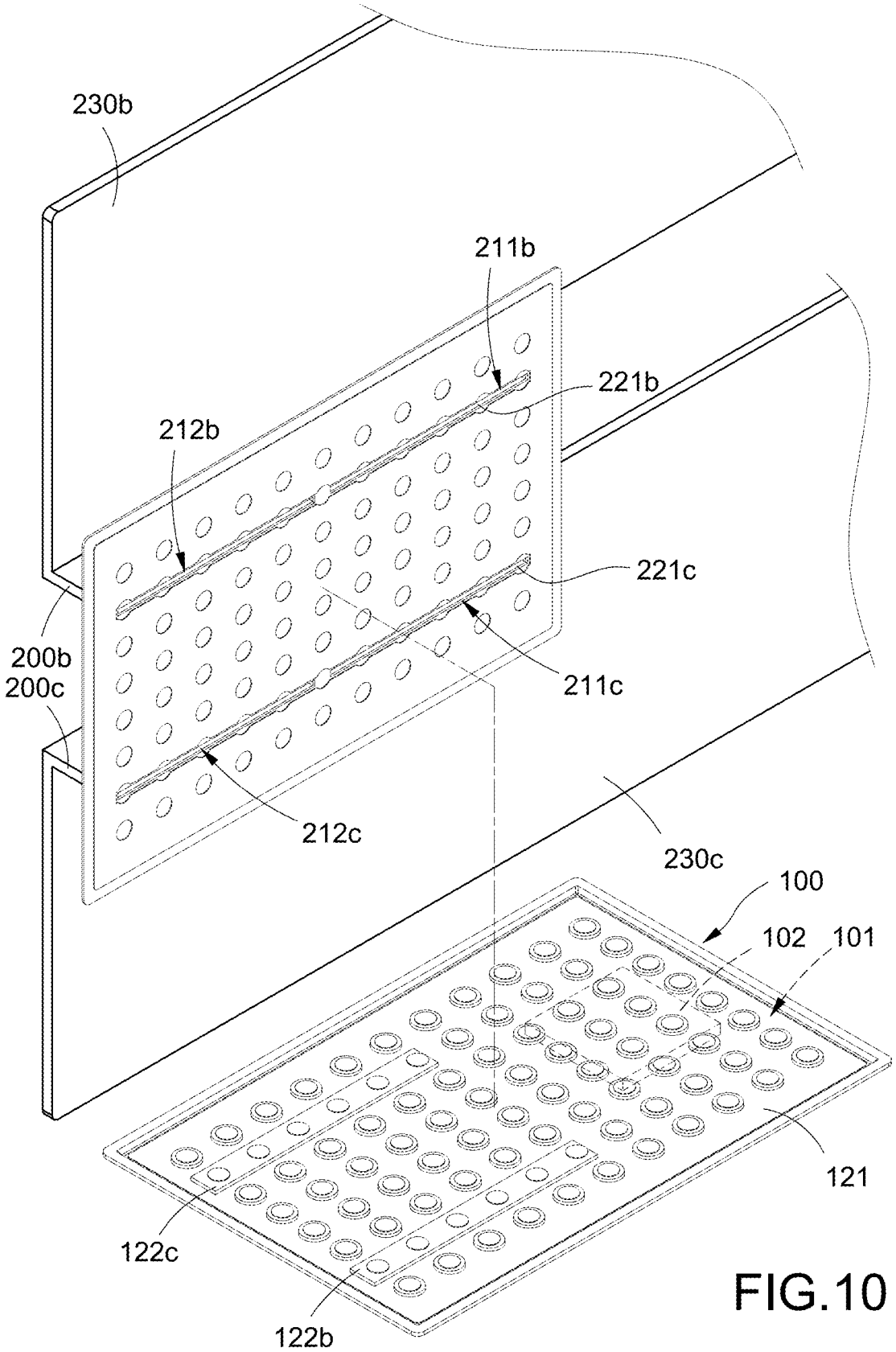
FIG. 10 is an exploded view showing the three-dimensional vapor chamber device according to another embodiment of this disclosure.
Figure 11:
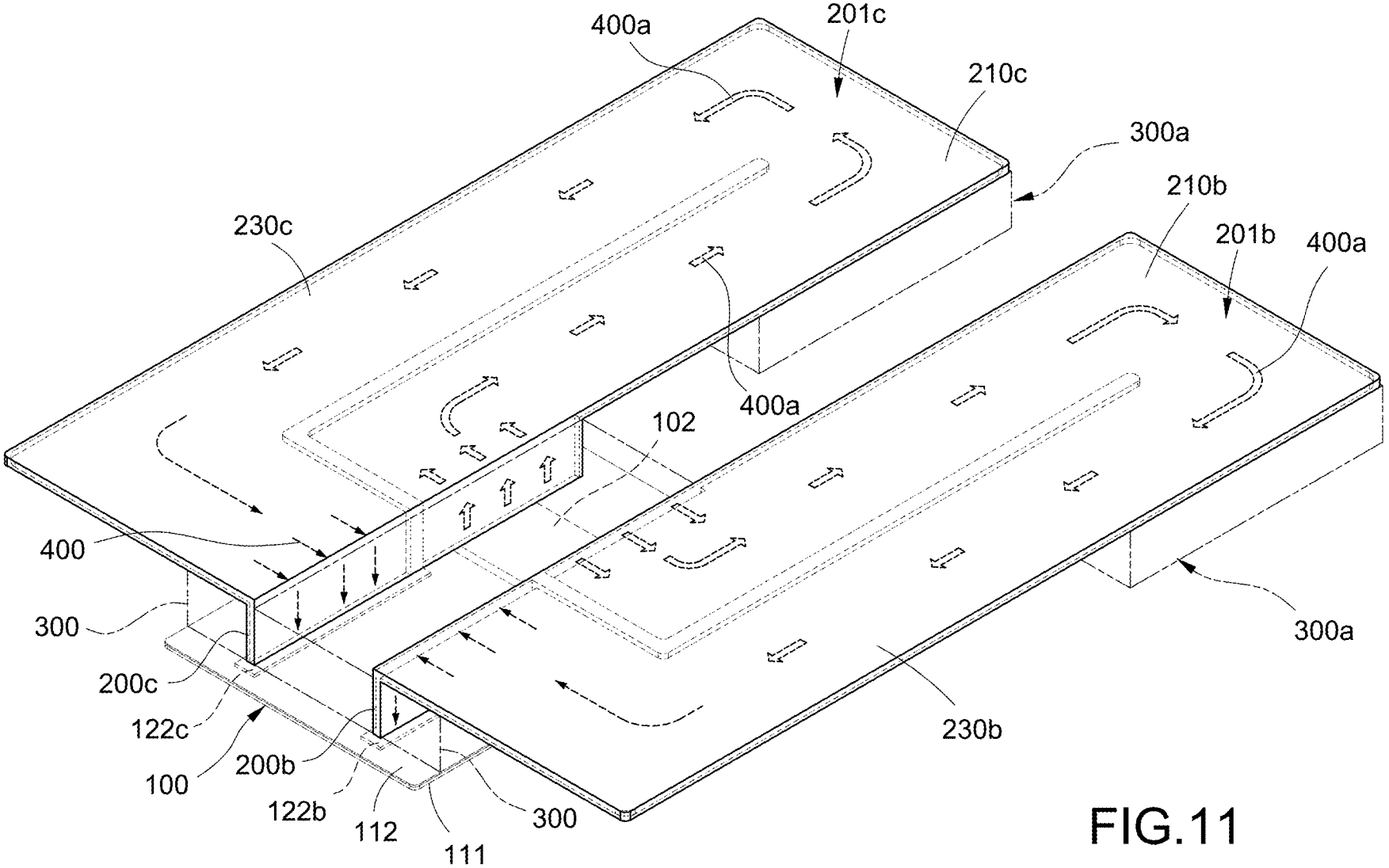
FIG. 11 is a perspective view showing the three-dimensional vapor chamber device in an operating status according to another embodiment of this disclosure.

According to FIGS. 9 to 11, another embodiment of this disclosure provides a three-dimensional vapor chamber device having a thermal conductive base 100, at least a vertical thermal plate 200*b* and a working fluid 400. Regarding a simplest embodiment, a predetermined function of this disclosure may be achieved by single vertical thermal plate 200*b*, although two vertical thermal plates 200, 200*c* having mirrored shapes are provided in this embodiment, scopes of this disclosure should not be limited to this embodiment.

According to this embodiment, the thermal conductive base 100 is a hollow plate having a plurality of housing parts assembled with each other, but scopes of this disclosure should not be limited to this embodiment. The thermal conductive base 100 has a heat exchanging surface 111 and a heat defusing surface 112 opposite to the heat exchanging surface 111, and a heat exchanging area 102 for contacting with a heat source is defined on the heat exchanging surface 111. A first chamber 101 is defined in the thermal conductive base 100, and a first capillary structure 121 is attached on an internal surface of the first chamber 101. The first capillary structure 121 is made of sintered metal powder and therefore having the plurality of pores.

According to this embodiment, the vertical thermal plates 200*b*/200*c* are hollow plates, and the vertical thermal plates 200*b*,200*c* are respectively combined with one of housing parts of the thermal conductive base 100, but scopes of this disclosure should not be limited to this embodiment. The vertical thermal plate 200*b*,200*c* are up-right arranged on the heat defusing surface 112 of the thermal conductive base 100, and a second chamber 201/201*a* is defined in each vertical thermal plate 200*b*/200*c*. A second capillary structure 221*b*/221*c* is attached on an internal surface of each second chamber 201*b*/201*c*, each second capillary structure 221*b*/221*c* is made of sintered metal powder and therefore having the plurality of pores. The first chamber 101 respectively communicates to each second chamber 201*b*/201*c* through an inlet 211*b*/211*c* and a return port 212*b*/212*c*. A flow channel structure 210*b*/210*c* is defined in each second chamber 201*b*/201*c*, and each flow channel structures 210*b*/210*c* is correspondingly connected between inlet 211*b*/211*c* of the second chamber 201*b*/201*c* and the return ports 212*b*/212*c*.

The three-dimensional vapor chamber device according to this disclosure further has at least one fin assembly 300/300*a*, the fin assembly 300/300*a* is arranged on an external surface of the vertical thermal plate 200*b*/200*c*. According to this embodiment, the three-dimensional vapor chamber device further has a plurality of fin assemblies 300, 300*a*, and the fin assemblies 300, 300*a* are respectively arranged on the external surfaces of the vertical thermal plate 200*b*/200*c* corresponding thereto. The vertical thermal plate 200*b*/200*c* may has an extended segment 230*b*/230*c*, the extended segment 230*b*/230*c* is parallel to the heat defusing surface 112, some of the fin assemblies 300*a* are respectively arranged on the extended segments 230*b*/230*c* corresponding thereto. The extended segment 230*b*/230*c* provides a space allowing another fin assembly 300*a* additionally arranged in a direction parallel to the thermal conductive base 100 so as to improve a heat exchange efficiency between the three-dimensional vapor chamber device and the environment air.

The liquid working fluid 400 accommodated in the first chamber 101 may be vaporized to flow to the second chambers 201*b*, 201*c* through the inlets 211*b*/211*c*, pass the flow channel structure 210*b*/210*c*, and then flow back to the first chamber 101 through the return ports 212*b*/212*c*, respectively. A flow resistance of the vaporized working fluid 400*a* from the heat exchanging area 102 to the return ports 212*b*/212*c* is greater than a flow resistance of the vaporized working fluid 400*a* from the heat exchanging area 102 to the inlet 211*b*/211*c*, so that the vaporized working fluid 400*a* flows toward the inlet 211*b*/211*c* corresponding thereto and enter the vertical thermal plate 200*b*/200*c* corresponding thereto.

According to this embodiment, a distance between the heat exchanging area 102 and each of the inlets 211*b*/211*c* is less than a distance between the heat exchanging area 102 and each of the return ports 212*b*/212*c* correspondingly, so that the flow resistances of the vaporized working fluid 400*a* from the heat exchanging area 102 to the return ports 212*b*/212*c* is greater than the flow resistances of the vaporized working fluid 400*a* from the heat exchanging area 102 to the inlets 211*b*/211*c*. A resistance structure 122*b*/122*c* is disposed at each return port 212*b*/212*c*, so that a flow resistance of the vaporized working fluid 400*a* from the heat exchanging area 102 toward the return ports 212*b*/212*c* is greater than a flow resistance of the vaporized working fluid 400*a* from the heat exchanging area 102 toward the inlets 211*b*/211*c*. The resistance structure 122*b*/122*c* may be made of sintered metal powder and therefore having the plurality of pores, and the resistance structure 122*b*/122*c* may be extended from the first capillary structure 121.

In an operating status of the three-dimensional vapor chamber device according to this disclosure, the liquid working fluid 400 is vaporized at the heat exchanging area 102 by heat absorbed from a heat source, the vaporized working fluid 400*a* flows into the vertical thermal plates 200*b*/200*c* so as to transfer the heat to the fin assembly 300/300*a*, and the heat is further dissipated to environment air. A period of the vaporized working fluid 400*a* lingering in the vertical thermal plate 200*b*/200*c* is extended by the flow channel structures 210*b*/210*c* so as to enhance the heat exchanging of the vaporized working fluid 400*a* in the vertical thermal plates 200*b*, 200*c*. Moreover, a flow resistance of the vaporized working fluid 400*a* from the heat exchanging area 102 to the return port 212*b*/212*c* is greater than a flow resistance of the vaporized working fluid 400*a* from the heat exchanging area 102 to the inlet 211*b*/211*c*, and this arrangement leads to a flow of the vaporized working fluid 400*a* along a specific path namely away from the heat source. Accordingly, the vaporized working fluid 400*a* is guided by the flow channel structures 210*b*, 210*c* to bring the heat away from the heat exchanging area 102, where the heat source is located. The working fluid has a specific flow path, thereby having a better and more stable heat transfer efficiency.

What is claimed is:

1. A three-dimensional vapor chamber device, comprising:

a thermal conductive base, comprising a heat exchanging surface, a heat defusing surface opposite to the heat exchanging surface, a heat exchanging area defined on the heat exchanging surface, a first chamber defined in the thermal conductive base, and a first capillary structure attached on an internal surface of the first chamber;

a vertical thermal plate, up-right disposed on the heat defusing surface, comprising a second chamber defined in the vertical thermal plate, a second capillary structure attached on an internal surface of the second chamber and an extended segment parallel to the heat defusing surface and extended outside a boundary of the thermal conductive base, the first chamber communicating with the second chamber through an inlet and a return port, a flow channel structure disposed in the second chamber, the flow channel structure communicating between the inlet and the return port;

a working fluid, accommodated in the first chamber, and configured to flow to the second chamber through the inlet, pass the flow channel structure and flow back to the first chamber through the return port;

a fin assembly, disposed on an external surface of the vertical thermal plate and disposed in a boundary of the thermal conductive base; and another fin assembly, arranged on the extended segment and dispose d outside a boundary of the thermal conductive base.

2. The three-dimensional vapor chamber device according to claim 1, wherein a flow resistance of the working fluid from the heat exchanging area to the return port is greater than a flow resistance of the working fluid from the heat exchanging area to the inlet.

3. The three-dimensional vapor chamber device according to claim 1, wherein a distance between the heat exchanging area and the inlet is less than a distance between the heat exchanging area and the return port.

4. The three-dimensional vapor chamber device according to claim 1, wherein a resistance structure is arranged at the return port.

5. The three-dimensional vapor chamber device according to claim 4, wherein the resistance structure comprises a plurality of pores.

6. The three-dimensional vapor chamber device according to claim 4, wherein the resistance structure is extended from the first capillary structure.

* * * * *